US009637918B1

(12) United States Patent
Carbajal

(10) Patent No.: US 9,637,918 B1
(45) Date of Patent: May 2, 2017

(54) CROSS RUNNER TO MAIN RUNNER ANCHOR CLIP

(71) Applicant: USG Interiors, LLC, Chicago, IL (US)

(72) Inventor: Victor M. Carbajal, Chicago, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/988,989

(22) Filed: Jan. 6, 2016

(51) Int. Cl.
*E04B 9/12* (2006.01)
*E04B 9/06* (2006.01)

(52) U.S. Cl.
CPC ..... *E04B 9/127* (2013.01); *E04B 9/068* (2013.01)

(58) Field of Classification Search
CPC . E04B 9/122; E04B 9/12; E04B 9/127; E04B 9/068
See application file for complete search history.

(56) References Cited

U.S. PATENT DOCUMENTS 3,305,256 A * 2/1967 Znamirowski ..... E04B 9/122 403/219
4,108,563 A * 8/1978 Brown ..... E04B 9/122 403/347
4,161,856 A * 7/1979 Brown ..... E04B 9/00 403/233
4,389,828 A * 6/1983 Cary ..... E04B 9/064 52/506.06
4,535,580 A * 8/1985 Shirey ..... E04B 9/10 52/506.06
4,549,383 A * 10/1985 Vukmanic ..... E04B 9/122 403/347
4,611,453 A * 9/1986 Worley ..... E04B 9/122 403/347
4,621,474 A * 11/1986 Worley ..... E04B 9/122 403/347
4,648,230 A * 3/1987 Mieyal ..... E04B 9/122 52/506.07
4,779,394 A * 10/1988 Shirey ..... E04B 9/122 52/506.07

(Continued)

OTHER PUBLICATIONS

Armstrong, Ceiling Systems, Single Tee Adapter Clip (STAC) Installation Instructions (2 pages), dated at least as early as Jan. 1, 2015.

(Continued)

*Primary Examiner* — Brian Mattei
*Assistant Examiner* — Gisele Ford
(74) *Attorney, Agent, or Firm* — Pearne & Gordon LLP

(57) ABSTRACT

A roll formed sheet metal main runner and a roll formed sheet metal cross runner intersecting the main runner from one side at a slot in the main runner, the cross runner having a sheet metal end connector extending through the slot, the connector having a lateral projection with a rearwardly facing edge and a hole rearward of the projection at which the connector is fixed to the cross runner, a stamped sheet metal anchor clip with a tongue projecting through the slot and a base connected to the tongue on a side of the main runner opposite the cross runner, the tongue having a relief area aligned with the connector projection, an edge abutting the connector projecting edge, and a hole aligned with the connector hole, and a fastener through both of said connector and tongue holes securing said clip to said connector.

2 Claims, 3 Drawing Sheets

(56) References Cited

U.S. PATENT DOCUMENTS 5,154,031 A * 10/1992 Wall ..... E04B 9/10 403/346
5,216,865 A * 6/1993 LaLonde ..... E04B 9/122 403/346
5,271,202 A * 12/1993 Vukmanic ..... E04B 9/122 52/506.07
5,517,796 A * 5/1996 Koski ..... E04B 9/122 52/506.07
5,761,868 A * 6/1998 LaLonde ..... E04B 9/122 52/506.07
5,839,246 A * 11/1998 Ziegler ..... E04B 9/068 403/347
5,893,249 A * 4/1999 Peterson ..... E04B 9/122 403/245
5,966,887 A * 10/1999 Mieyal ..... E04B 9/122 52/506.07
6,047,511 A * 4/2000 Lehane ..... E04B 9/068 29/521
6,178,712 B1 * 1/2001 Sauer ..... E04B 9/122 52/506.06
6,199,343 B1 * 3/2001 Sauer ..... E04B 9/068 403/347
8,813,457 B2 * 8/2014 Underkofler ..... E04B 9/30 248/221.11
2004/0159064 A1 * 8/2004 Okumura ..... E04B 9/127 52/506.06
2005/0166509 A1 * 8/2005 Sareyka ..... E04B 9/125 52/506.07
2005/0166523 A1 * 8/2005 Platt ..... E04B 9/067 52/633
2006/0165481 A1 * 7/2006 Barbuio ..... E04B 9/122 403/346
2006/0260244 A1 * 11/2006 Platt ..... E04B 9/068 52/506.06
2009/0293403 A1 * 12/2009 Cedrone ..... E04B 9/10 52/506.06
2011/0131913 A1 * 6/2011 Lehane, Jr. ..... E04B 9/122 52/506.1
2011/0146184 A1 * 6/2011 Lehane, Jr. ..... E04B 9/122 52/506.07
2011/0239575 A1 * 10/2011 Dallan ..... E04B 9/122 52/506.07
2011/0239576 A1 * 10/2011 Dallan ..... E04B 9/122 52/506.07
2012/0042584 A1 * 2/2012 Sareyka ..... E04B 9/068 52/167.1
2012/0085060 A1 * 4/2012 Dallan ..... E04B 9/122 52/506.07
2012/0085061 A1 * 4/2012 Dallan ..... E04B 9/122 52/506.07
2012/0291388 A1 * 11/2012 Lehane, Jr. ..... E04B 9/068 52/506.07
2013/0061550 A1 * 3/2013 Underkofler ..... E04F 13/0803 52/506.05
2013/0205689 A1 * 8/2013 Lillette ..... E04B 9/06 52/167.1
2013/0318905 A1 * 12/2013 Underkofler ..... E04B 9/122 52/506.06
2014/0069041 A1 * 3/2014 Sareyka ..... E04B 9/122 52/506.05
2015/0040494 A1 * 2/2015 Lehane, Jr. ..... E04B 9/122 52/220.6
2015/0040495 A1 * 2/2015 Lehane, Jr. ..... E04B 9/122 52/220.6
2015/0085474 A1 * 3/2015 Sareyka ..... E04B 9/10 362/147
2015/0197937 A1 * 7/2015 Jankovec ..... E04B 9/127 52/506.07
2015/0337532 A1 * 11/2015 Cipriani ..... E04B 9/10 52/848

OTHER PUBLICATIONS

Chicago Metallic, Suspension Systems, http://www.rockfon.com/u/cmc_product/166/Chicago%20Metallic%201493%20Unopposed%20Tee%20Clip/, (2 pages), published at least as early as Jan. 1, 2015.

Armstrong, Ceiling Systems, Metalworks, Optima and Spectra Capz Installation Instructions (2 pages), Section 2.2.5, published at least as early as Jan. 1, 2015.

* cited by examiner

CROSS RUNNER TO MAIN RUNNER ANCHOR CLIP

BACKGROUND OF THE INVENTION

The invention relates to an accessory for suspended ceiling systems and, in particular, to a clip for anchoring single cross runners at main runner receiving slots.

PRIOR ART

Conventional suspended ceiling grid involves spaced parallel main runners and spaced parallel cross runners disposed between and at right angles to the main runners. The main runners are typically joined directly end-to-end so that they are effectively uninterrupted across the ceiling while runs of the cross runners are interrupted at intersections with the main runners. Joints between the cross runners are made through openings or slots formed in the main runners.

Present day cross runners have end connectors that when inserted in a common main runner slot from opposite sides establish two mutual connections, one on each side of the main runner. These connections are quite strong and resist separation when a tensile force is applied to the cross runners. The tensile strength of a joint between two cross runner end connectors is typically sufficiently high to satisfy seismic code regulations.

There are ceiling grid patterns where only one grid cross runner is located at its intersection with a main runner. Typically, cross runner end connectors have limited pull out resistance where no opposed end connector is available. The pull out or tensile force of a single end connector ordinarily is well below seismic code requirements. Some grid manufacturers offer clips for use with their grid cross runners to augment tensile strength of a single connector at a main runner slot.

SUMMARY OF THE INVENTION

The invention provides a clip for anchoring single cross-runner ends in a main runner slot. The inventive clip achieves a resistance of the cross runner to pull out at a level that, at least, satisfies current seismic building codes. The clip is small, inexpensive to produce, and easy to install.

The disclosed clip is a sheet metal stamping that occupies a main runner slot with the end connector of the cross runner being anchored. A forward end of the clip is inserted in the main runner slot from a side opposite that from which the cross runner end connector is inserted. The clip is configured to inter-engage with the catch detail of the end connector so that these parts are self-aligning and self-locking. The disclosed clip, additionally, is configured with a hole that aligns with an existing hole in the connector. A separate fastener is inserted through these holes to positively lock the clip and connector together and thereby fully anchor the cross runner to the main runner.

A rearward portion of the clip is larger than the main runner slot so that once the cross runner end connector is locked to the clip, the cross runner cannot pull away from the main runner under loads less than currently prevailing seismic load specifications.

DESCRIPTION OF THE PREFERRED EMBODIMENT

Figure 1:
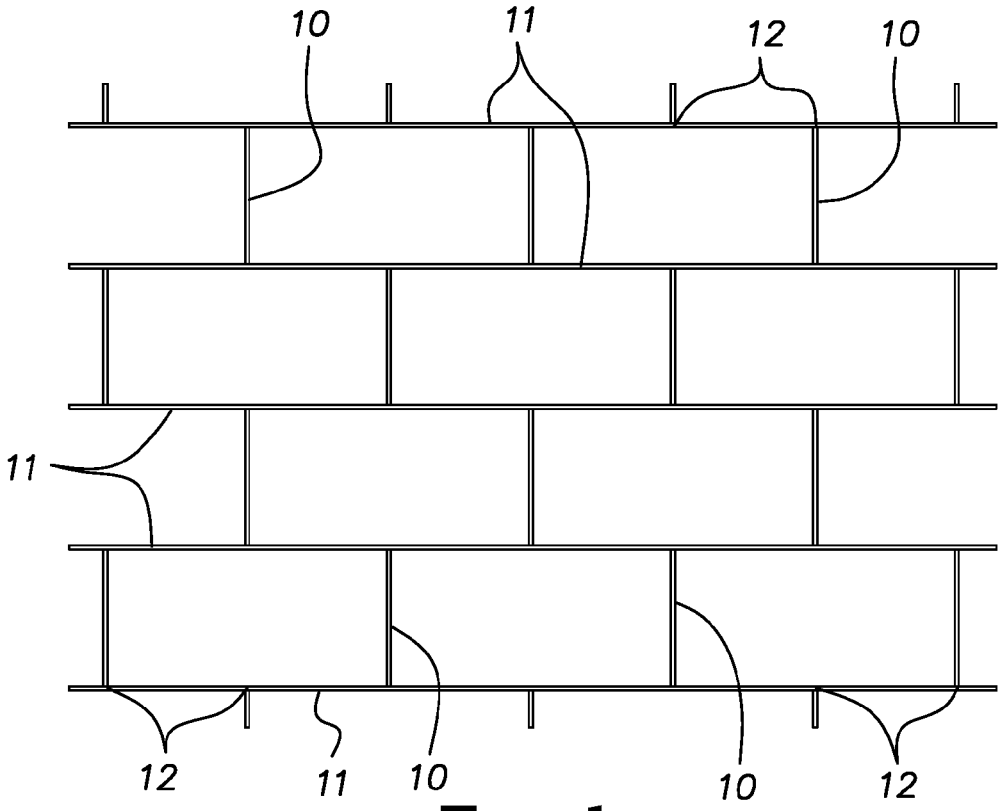
FIG. 1 is a fragmentary plan view of a suspension ceiling grid having a staggered bond appearance.
Figure 2:
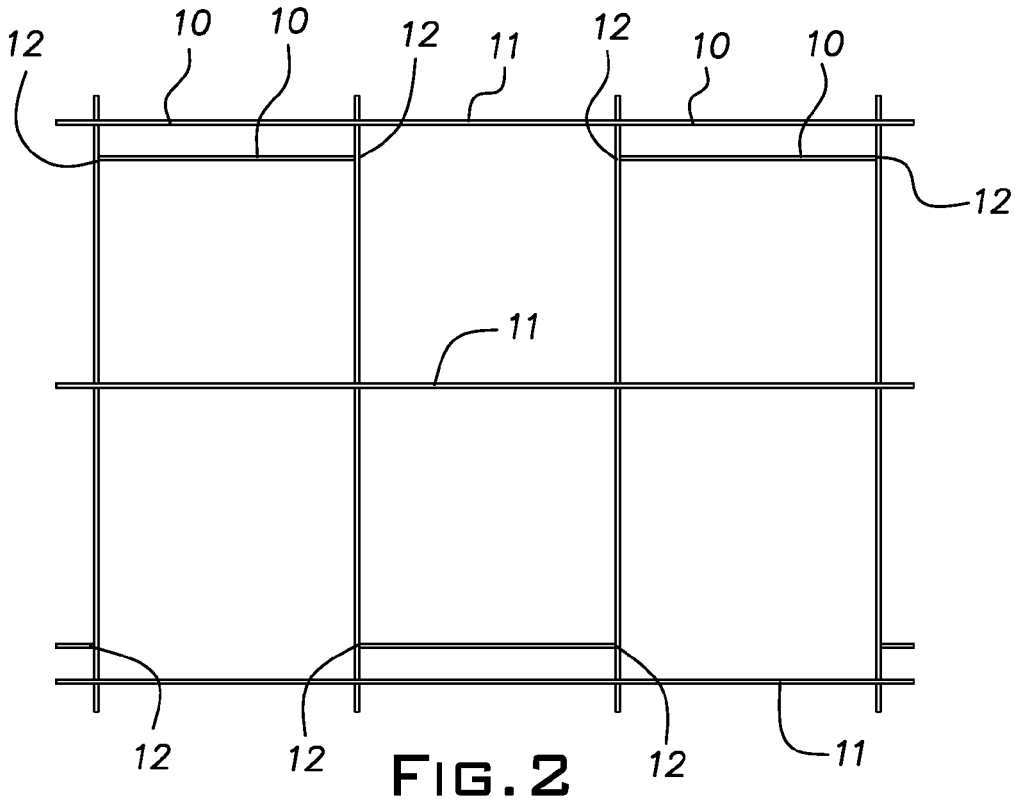
FIG. 2 is a fragmentary plan view of a suspended ceiling grid with a staggered light fixture pattern.

FIGS. 1 and 2 illustrate examples of suspended ceiling grid patterns where cross runners 10 intersect main runners at locations 11 where there is no opposing cross runner sharing an intersection site. In FIG. 1, the grid pattern is arranged in a brick or ashlar pattern. In FIG. 2, the grid pattern is arranged to accommodate light fixtures 12 within standard grid modules, typically 4 foot×4 foot. Dimensions used herein can be those of standard industry metric equivalents. Most commonly, the grid runners 10, 11 have a T-like configuration and, hence, are sometimes called grid tees or simply tees. The runners 10, 11 are typically roll formed sheet metal, usually steel, products. The main runners 11 are typically 10 or 12 foot long while the cross runners 10 are typically 4 foot long. These dimensions are nominal.

Cross runner end connectors 16 and main runner slots 17 for receiving the end connectors can be of the type disclosed in U.S. Pat. Nos. 5,517,796 and 5,761,868.

The end connectors 16 are preferably made of high tensile steel and are affixed on ends of the cross runners 10 with integral rivet-like formations in which material of the runner is stamped into a hole in the connector and flared out against the opposite side of the connector. The rivet formations leave two holes 18 through both the end connector 16 and cross runner 10.

The connector 16 has a tab feature 19 that produces a connection with the main runner 11 when it is inserted or "stabbed" through the slot 17. The tab feature 19 resists low level tensile loads on the cross runner 10 to keep the cross runner connected under normal conditions such as when a grid is being erected.

Figure 5:
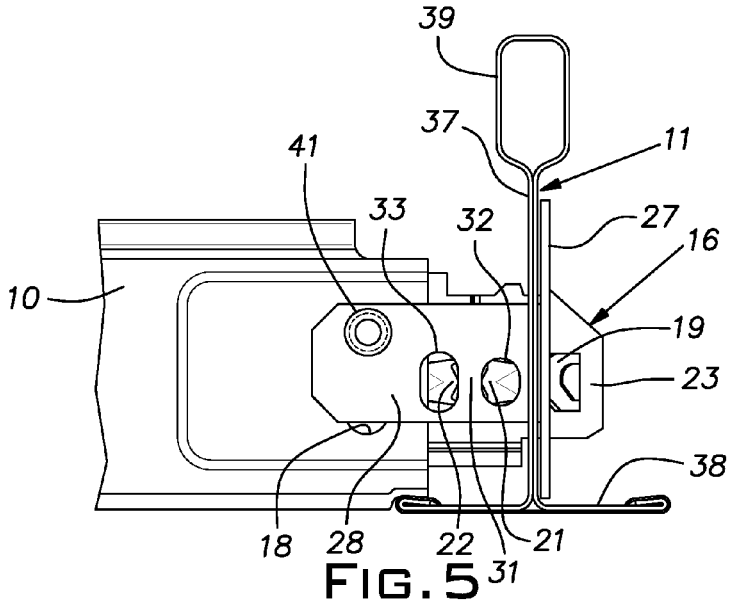
FIG. 5 is a side view of the assembly of the clip and end connector of the cross runner in the main runner slot.

The end connector 16 has a pair of lanced catches 21, 22 projecting to one side of a main plane of the connector. In FIG. 5, the catches or projections 21, 22 project towards the space above the plane of the drawing. The forward projection 21 has a rearwardly facing edge and the rearward projection 22 has a forwardly facing edge. The connector 16 includes a strap 23 at its lead end. Where two opposed cross runners 10 have their end connectors sharing a common slot in the main runner, the strap 23 of one connector fits between the projections 21, 22 of the other and vice versa. The opposed connectors are held together in abutting contact by the sides of the main runner slot 17. The result is a very strong connection capable of sustaining forces in excess of recognized seismic code requirements.

Figure 3:
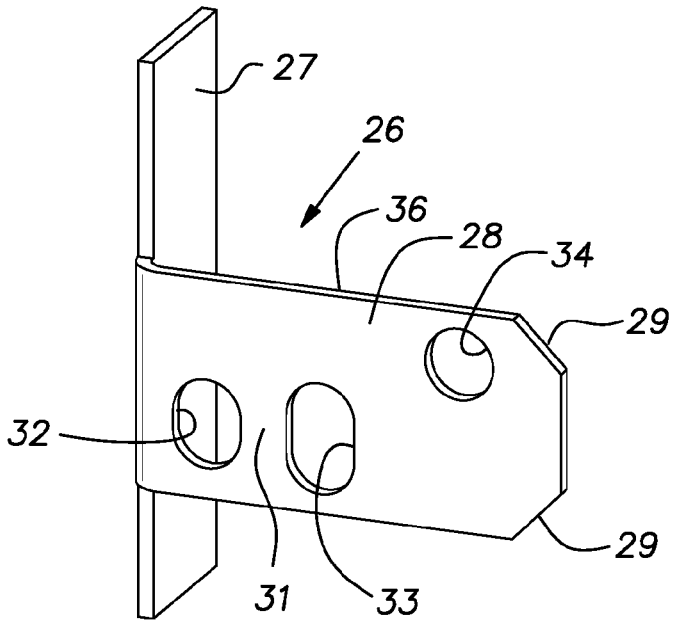
FIG. 3 is a perspective view of the anchor clip of the invention.
Figure 4:
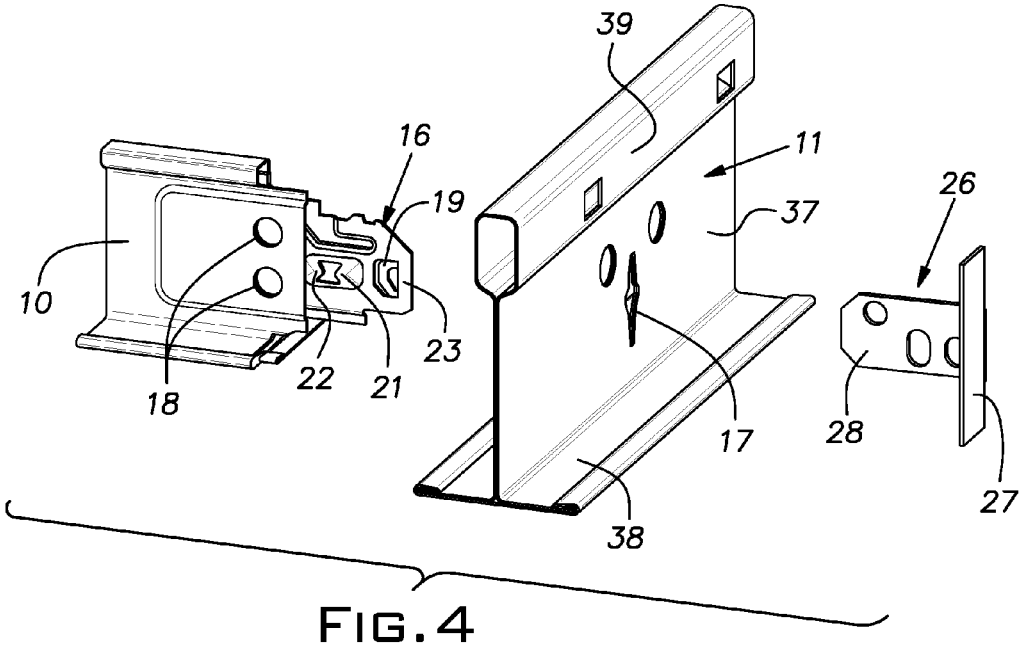
FIG. 4 is an exploded perspective view of the inventive clip, a slot of a main runner and an end of a cross runner to be installed in the slot.

The invention provides a clip 26, shown in FIGS. 3-5, used where only one cross runner intersects a main runner at a slot 17. An example of a main runner slot 17 is shown at FIG. 5. Ideally, the clip 26 is a sheet metal stamping having a generally flat rectangular base 27 and a generally flat tongue 28. The clip can be formed, for example, of 0.022 inch hot dipped galvanized steel. The base 27 and tongue 28 form a right angle and in normal use lie in respective intersecting vertical planes. The base 27 extends vertically below and above the tongue 28.

An end of the tongue 28 distal from the base 27 is shaped with converging edge areas 29 to facilitate insertion of the tongue 28 into a main runner slot 17. The tongue 28 has a connector mating zone 31, in the illustrated embodiment, formed between two horizontally spaced apertures 32, 33. The apertures 32, 33 serve as relief areas proportioned to receive respective ones of the projections or catches 21, 22 on an end connector 16 of a cross runner 10 being anchored by the clip 26. A hole 34 is provided in the tongue 28 adjacent its distal end and upper edge 36. The height of the tongue 28 is proportioned to provide a sliding fit between the top and bottom of the main runner slot 17.

As mentioned, FIGS. 1 and 2 illustrate single cross runner to main runner intersections where the connector 16 has insufficient tensile strength along a cross runner to be compliant with seismic regulations. The disclosed clip 26, when used with a connector 16, greatly increases the pull out resistance of a cross runner from a main runner slot 17.

The clip 26 can be installed in a main runner slot prior to insertion of the cross runner end connector 16 or after, as desired by the technician installing the grid. The clip 26 is installed by inserting the tongue 28 through a slot 17 from a side opposite the cross runner location until the base 27 abuts a web 37 of the main runner 11. FIGS. 4 and 5 illustrate that the base 27 extends below the tongue 28 a distance substantially equal to the height of the bottom of the slot 17 above a flange 38 of the main runner 11 so that minimal clearance between the base and flange exists. The upper edge of the base 27 is arranged so that it is adjacent a reinforcing bulb 39 of the shortest main runner 11. The relatively large area of the base 27 enables the technician to use essentially all of the width of his/her thumb to apply pressure during installation of the clip and/or the end connector 16. With the base 27 abutted against the web 37 of the main runner 11, the end connector 16 on a side of the tongue 28 opposite the base 27 and the end connector fully inserted in the slot 17, the clip 26 and end connector 16 are self-aligning. The mating zone 31 snaps into the space between the lanced catches or projections 21, 22 and the fastener hole 34 aligns with the upper hole 18 of the cross runner 10. The rearwardly facing edge of the projection or catch 21 abuts the mating zone edge and resists tensile forces in the cross runner 10. The clip 26 and connector 16 are fixed together with a pop rivet 41 inserted through both the connector hole 18 and the hole 34 in the tongue. Alternatively, a self-drilling screw can be used in place of the pop rivet 41 where the clip hole 34 is appropriately sized for the screw being used. Thus, both the projection 21 and the fastener 41 resist tensile forces on the cross runner 10.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In combination, a roll formed sheet metal main runner and a roll formed sheet metal cross runner intersecting the main runner from one side at a slot in the main runner, the cross runner having a sheet metal end connector extending through the slot, the connector having a lateral projection with a rearwardly facing edge and having a hole rearward of the projection at which the connector is fixed to the cross runner, a stamped sheet metal anchor clip with a tongue projecting through the slot and with a base connected to the tongue on a side of the main runner opposite the cross runner, the tongue having a relief area aligned with the connector projection, an edge of the relief area abutting the rearwardly facing edge, and a tongue hole aligned with the connector hole, and a fastener through both of said connector and tongue holes securing said clip to said connector.

2. The combination as set forth in claim 1, wherein said connector has a second projection with an associated edge opposed to the edge of the first mentioned projection, the tongue having a mating zone disposed between said edges.

* * * * *